United States Patent [19]

Leins et al.

[11] Patent Number: 5,003,793

[45] Date of Patent: Apr. 2, 1991

[54] CARD WHEEL FOR A KNITTING MACHINE FOR MAKING KNIT GOODS WITH COMBED-IN FIBERS

[75] Inventors: Eberhard Leins, Filderstadt; Klaus Kunde, Kohlberg, both of Fed. Rep. of Germany

[73] Assignee: Terrot Strickmaschinen GmbH, Stuttgart, Fed. Rep. of Germany

[21] Appl. No.: 253,073

[22] Filed: Oct. 4, 1988

[30] Foreign Application Priority Data

Oct. 5, 1987 [DE] Fed. Rep. of Germany ..... 3733594
Jan. 15, 1988 [DE] Fed. Rep. of Germany ..... 3801031

[51] Int. Cl.[5] ..... D04B 9/14
[52] U.S. Cl. ..... 66/9 B; 19/114
[58] Field of Search ..... 19/114; 66/9 B

[56] References Cited

FOREIGN PATENT DOCUMENTS 128552 8/1900 Fed. Rep. of Germany .
458840 1/1926 Fed. Rep. of Germany ..... 19/114
2145459 3/1972 Fed. Rep. of Germany .
2128620 12/1972 Fed. Rep. of Germany .
2846110 4/1980 Fed. Rep. of Germany .
3211520 10/1982 Fed. Rep. of Germany .
3407392 4/1985 Fed. Rep. of Germany .
53-2632 1/1978 Japan ..... 19/114

*Primary Examiner*—Wm. Carter Reynolds
*Attorney, Agent, or Firm*—Michael J. Striker

[57] ABSTRACT

The invention relates to a card wheel for a knitting machine for manufacturing knit goods with combed-in fibers. The card wheel consists of a wheel body with a cylindrical circumferential surface and a card clothing situated and fixed on the latter, which contains a cloth band of appropriate width lying on the circumferential surface and hooks incorporated into the band. In accordance with the invention the cloth band has at least one lateral end a holding section free of hooks which runs along the entire circumferential surface. To fix the card clothing in place, a clamping means acting on the holding section is provided in accordance with the invention, which clamps the holding section with a pressure per unit area on the circumferential surface which prevents the cloth band from slipping.

13 Claims, 5 Drawing Sheets

CARD WHEEL FOR A KNITTING MACHINE FOR MAKING KNIT GOODS WITH COMBED-IN FIBERS

BACKGROUND OF THE INVENTION

The invention relates to a card wheel for a knitting machine for making knit goods with combed-in fibers, consisting of a wheel body with a cylindrical circumferential surface and card clothing fixed thereon, the card clothing consisting of a band of corresponding width and of wire hooks embedded in the latter.

Known card wheels of this kind (DE-OS 31 33 280) offer chiefly the advantage that they permit a more uniform fiber density in the knit goods made with them than do conventional card wheels which are provided with spirally wound and therefore usually irregularly disposed card clothing. This is especially true when the hooks, as seen in the circumferential direction, are inserted into a band of constant width. It is true that problems are still encountered in achieving a sufficiently secure, i.e., non-slipping and distortion-free fastening of such card clothing onto the card wheels. Fastening the clothing by cementing has the additional disadvantage that the band, which is of a textile nature as a rule, is attacked by the adhesive and that the wheel surface would have to be cleaned when the card clothing is replaced. It is therefore disclosed in DE-OS 34 07 392 to lay a rectangular strip of card clothing onto the circumferential surface of the wheel, bring together the two ends of the card clothing with the formation of a narrow seam running parallel to the wheel axis, and clamp the ends together by driving clips through the material. The consequence of this method of fastening, however, is that the clips driven into the band affect its elasticity, so that the card hooks disposed in the area of the seam perform differently in the incorporation of the fibers than the card hooks in the other areas. In addition, the clips driven into the card clothing entail the danger of damaging the latter when it is tightened to the degree needed to assure its slippage-free installation on the wheel. But if the tightening force applied is low enough to reliably prevent damage to the card clothing, the strength of adhesion in those sections of the card clothing that are outside of the area of engagement of the clips is not sufficient to exclude the danger of card clothing distortions, wrinkling or the like, during operation. Lastly, card wheels using the above-mentioned clips are complicated and expensive.

The invention addresses itself to the task of proposing a method of fastening by which the card clothing can be fastened on the card wheel of the kind referred to above such that it will lie in a slippage free manner against the entire circumference of the wheel, that no distortions will occur during operation, no expensive modifications of the conventional wheels will be necessary, and that damage to the card clothing will be securely prevented.

SUMMARY OF THE INVENTION

This task is accomplished by the fact that the card clothing band has a holding section free of card hooks running around the entire circumferential surface and, to hold the card clothing in place, a clamping means is provided which acts on the holding section and grips the holding section with a pressure per unit area that prevents the card clothing from slipping.

The invention offers the advantage that the clamping means acts only on a section of the card clothing band that is free of hooks and therefore does not participate in the incorporation of fibers, and consequently it cannot impair the desired operation of the hooks nor damage the actual working section of the card clothing. Because of the flexible properties of the card clothing it is also possible to exert a comparatively great pressure on the holding section with the clamping device. The clamping device preferably contains a ring lying on the holding section and penetrating to a defined depth into the card clothing band, thereby producing the desired pressing of the holding section along the entire circumference of the wheel so as to prevent any tendency to slip. In the use of the card wheel in accordance with the invention no distortions, wrinkling or the like of the card clothing has been observed in the operation of the knitting machine.

Additional advantageous features of the invention will be found in the subordinate claims.

BRIEF DESCRIPTION OF THE DRAWINGS

The invention will be further explained below in connection with the appended drawing of examples of its embodiment.

DESCRIPTION OF PREFERRED EMBODIMENTS

Figure 1:
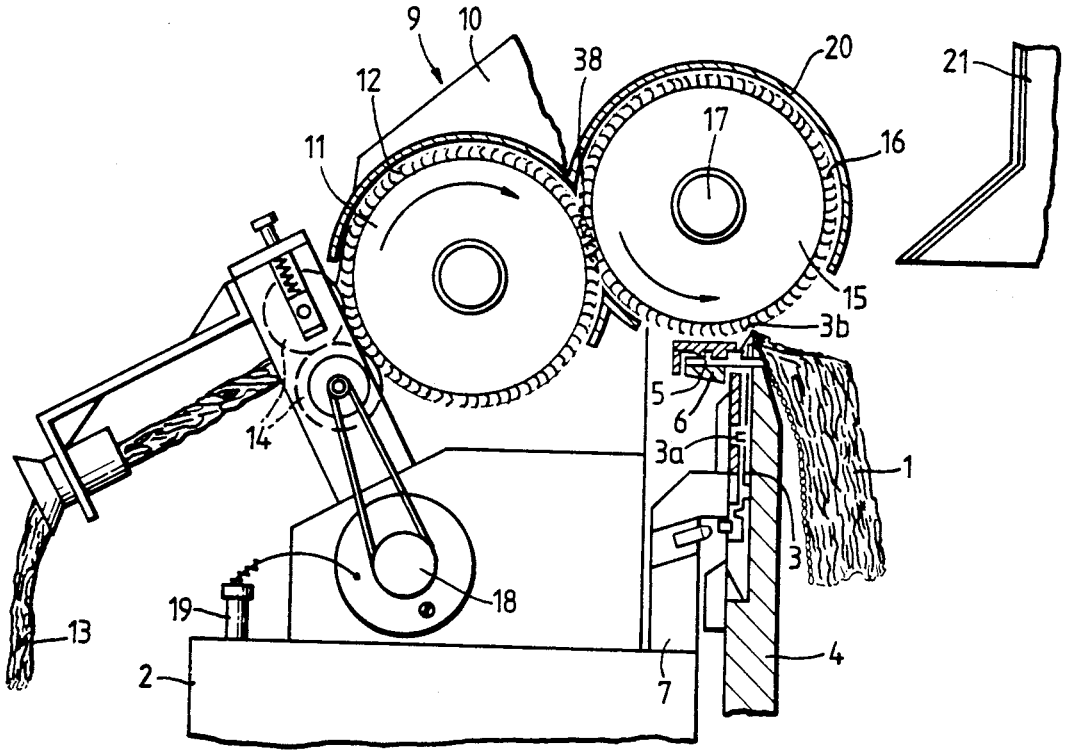
FIG. 1 represents a circular knitting machine with a plurality of card wheels for the production of knit goods with combed-in fibers.

As seen in FIG. 1, a circular knitting machine for the production of knit goods 1 with combed-in fibers has a base plate 2 in which a needle cylinder 4 equipped with knitting needles 3 is journaled, together with a sinker ring 6 provided with sinkers 5. The knitting needles 3 and sinkers 5, usually controlled in a conventional manner by cams, usually at a plurality of fiber feeding stations spaced at intervals around the needle cylinder, which act on the butts *3a* of the knitting needles and corresponding butts of the sinkers 5. The fiber feeding stations can furthermore be provided each with a patterning device 7 by which the knitting needles are selected according to a pattern for picking up the fibers.

At each fiber feeding station there is furthermore provided a feeding system 9 which is fastened to a frame 10 and serves to feed fibers to the knitting needles 3 selected for fiber pick-up, and to comb these fibers into the hooks *3b* of the knitting needles 3. Each feeding system consists preferably of a conventional carding or combing apparatus bearing a plurality of card wheels, which has, for example, a card wheel 11 in the form of a drum or opening roll with a card clothing 12, to which fibers are fed in the form of a sliver 13 by means of a pair of card wheels 14, and an additional card wheel 15 in the form of a pick-up or comb-in roll with a card clothing 16 by means of which the fibers taken from the card wheel 11 are laid into the knitting needles 3 which have been selected for fiber pickup. The card clothings 12 and 16 have, in a known manner, flexible bent wire hooks or the like, between which gaps are provided for the passage of the needle hooks 3*b* of the selected knitting needles.

The card wheels 11, 14 and 15 are journaled in the frame 10, the axis of rotation of the card wheel 15 being identified by the reference number 17. All of the card wheels can be set in rotation by means not shown, the rotatory movements being derived, as a rule, via belts or gears, from the motor driving the needle cylinder, or from a gear joined to the needle cylinder.

FIG. 1 shows schematically a means 18 for driving the card wheels 14, a control system 19 being also provided, by means of which the fibers can be transferred to the card wheels 11 and 14 in the amount the pattern calls for. Also, a cover 20 can be provided to at least partially surround the card wheels 11 and 15 to prevent undesirable emission of lint, and an exhaust hood 21 for the disposal of loose fibers.

Circular knitting machines of the kind described are disclosed in German Federal Patents 1,201,509 and 2,115,721, Offenlegungsschrift 2,307,111 and German Federal Gebrauchsmuster 82 16 932, to which reference is here expressly made.

Figure 2:
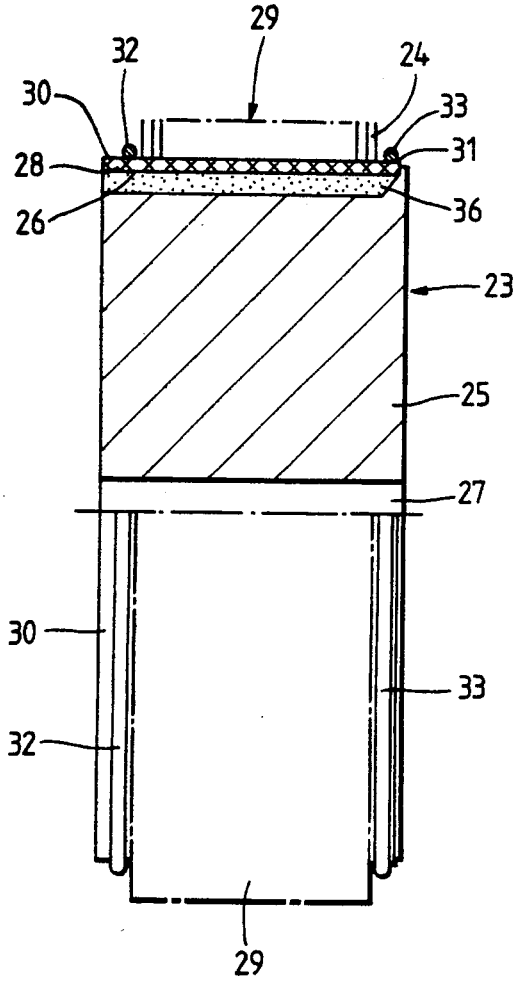
FIG. 2 an enlarged, partially cut-away front view of a card wheel in accordance with the invention.
Figure 3:
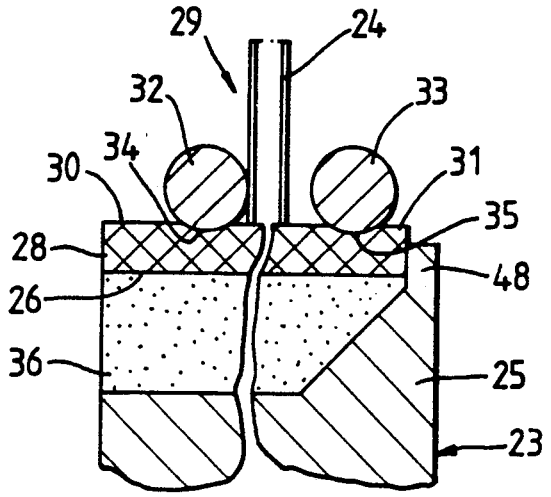
FIG. 3 an enlarged detail of FIG. 2.

FIGS. 2 and 3 show a card wheel 23 which can be used, for example, for the card wheels 11 and 15, if the card hooks 24, which are indicated only diagrammatically, are appropriately formed, but it can also be used for the card wheels 14. Card wheel 23 consists of a wheel body 25 with a cylindrical circumferential surface 26 and a central bore 27 for a drive shaft. The hooks 24 consist, in a conventional manner, of staple-like, bent wire hooks which are driven through a band 28 and form with the latter the card clothing 29. The band 28 usually contains at least one layer consisting of cloth, e.g., woven cotton, placed against the circumferential surface 26, and a flexible and resilient backing layer, of foam or sponge rubber for example, fastened on the outer circumference of the wheel. If necessary, additional intermediate layers can be disposed between the cloth layer and the backing layer. The backs of the staple-like wire hooks, which are not shown, are held by the cloth as in U.S. Pat. No. 944,031.

In accordance with the invention, the cloth band has on at least one lateral end a holding section 30 free of the hooks 24 and running around the entire circumferential surface 26; it is represented on the left margin in FIGS. 2 and 3. Preferably, the cloth band 28 is provided also on its other margin as shown in FIG. 3 with a hook-less holding section 31. The card clothing 29 is fixed in place by a clamping means having at least one ring 32 which is placed on the left-hand holding section 30 in FIGS. 2 and 3. Preferably a similar ring 33 is placed on the right holding section in FIGS. 2 and 3. Preferably, the cloth band where it is occupied by the hooks has the same width along the entire circumferential surface. The clamping rings 32 and 33 serve to press the holding sections 30 and 31 against the circumferential surface 26 with such great pressure per unit area that any slippage of the holding section 30, 31, and hence of the entire card clothing 29, on the circumferential surface 26 of the card wheel, will be prevented by the friction created by the rings.

The necessary pressure per unit area can be produced in a variety of ways. Preferably the clamping rings are continuous steel wire rings which at least in their cross section are unyielding or virtually unyielding, and have an inside diameter that is smaller than the outside diameter of the holding sections 30 and 31 when the latter are already lying on the circumferential surface 26 of the wheel body 25, but greater than the diameter of the circumferential surface 26 itself. In the installed state the rings 32 and 33 will penetrate to a defined depth into the cloth material at the holding sections 30 or 31 due to the compressible qualities of the cloth, as is indicated in FIG. 3 by the trough-like depressions 34 and 35 in the holding sections 30 and 31. Through the appropriate selection of the inside diameter of the rings 31 and 33, this depth of penetration can be made such that, even allowing for common tolerances in the production of the wheel bodies 25 and/or of the card clothing 29, a certain minimum friction will be produced between the circumferential surface 26 and the holding sections 30 and 31. Alternatively it would also be possible to use flexible wires or bands as rings 32 and 33, joining their ends together with a tension lock or in some other manner, and clamping them together after placing them on the holding sections 30 and 31 so as to achieve the desired pressure per unit area or the desired friction.

The cloth band 28 is preferably made in one piece as an endless band and then equipped with the hooks 24. It is especially advantageous to apply this endless band with a certain bias, i.e., with a slight elastic stretching, onto the circumferential surface 26, in order to achieve a particular tightness and a particular friction between the card clothing 29 and the wheel body 25. Alternatively, it would also be conceivable to make the card clothing 29 in the form of a rectangular strip with a width corresponding substantially to the width of the circumferential surface 26, place it onto the circumferential surface, bring its extremities together along a fine abutment seam, and then apply the clamping rings 32 and 33, although such a solution is not optimum on account of the seam.

The holding sections 30 and 31 are preferably kept entirely free of the hooks 24 by not inserting any hooks into these sections when preparing the card clothing 29, in order thereby to make optimum use of the flexible and resilient properties of the cloth band 28. It would be conceivable, in any case, to form the holding sections 30 and 31 by extracting the hooks 24 previously inserted in them or by cutting the hooks off along the surface of the outer surface of the cloth band, although this last-named method greatly impairs the flexible and resilient properties especially of the cloth band and therefore requires at least a substantially greater clamping force on the part of the rings 32 and 33.

In accordance with an especially preferred embodiment of the invention, the circumferential surface 26 is formed not by the surface of the wheel body, which as a rule consists of an aluminum casting, but by the circumferential surface of a wear-resistant and at least slightly resilient coating 36 (FIGS. 2, 3) applied to the circumference of the wheel body 25. This coating 36 has a damping effect on the spring action of the backs of the staple-like hooks 24 in contact with the back of the cloth band 28, prevents scratches on the surface of the wheel body 25, and provides the circumferential surface 26 with better friction than a smooth, hard aluminum surface. The coating 36 can be produced, e.g., by vulcanizing a polyurethane onto the wheel body 25, so that it will be rigidly joined to the latter and held against shifting thereon.

Figure 4:
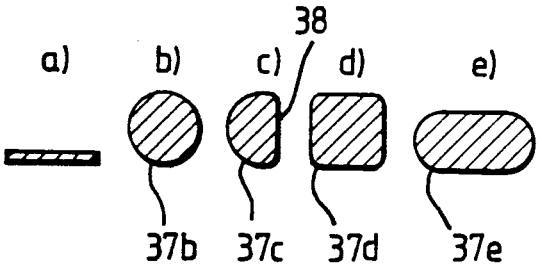
FIG. 4 a number of different cross-sectional shapes for a clamping ring of the card wheel of FIGS. 1 to 3.

FIG. 4 shows a number of preferred cross-sectional shapes of the clamping rings 32 and 33. The rectangular cross-sectional shape shown in FIG. 4*a* is that of a flat band which is tightened onto the circumferential surface 26 by means of a tension lock or other suitable tightening means. FIGS. 4*b* to 4*e*, however, relate to cross-sectional shapes which produce the trough-like depressions 34 and 35 on the holding sections 30 and 31, and are suited especially for endless clamping rings 32 and 33. When the rings 32 and 33 are drawn onto the holding sections 30 and 31, the front faces of the rings, indicated by the references 37*b*, 37*c*, 37*d* and 37*e*, coming in contact with the ends of the holding sections, are each rounded to enable them to be slipped onto the latter more easily in a runner-like manner and prevent them from driving the holding sections 30 and 31 ahead of them parallel to the axis of the wheel body 25 as they are installed. The cross section of FIG. 4*b* is circular as in FIGS. 2 and 3; the cross section of FIG. 4*c* is substantially semicircular as in FIG. 5, such that a substantially planar back 38 adjoins the rounded front surface 37*c*; the cross section of FIG. 4*d* is substantially square, but with rounded corners, and the cross section of FIG. 4*e* is substantially a flat oval.

Figure 5:
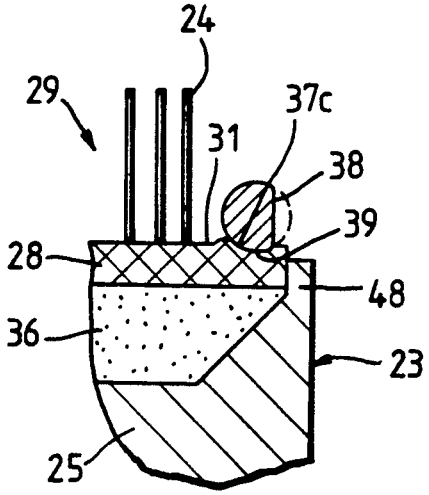
FIG. 5 an enlarged cross-sectional detail similar to FIG. 3, taken through an additional embodiment of the invention.

Additional advantages are obtained by using the cross-sectional shape of FIG. 4*c* which is, up to now, the best one. These clamping rings result in the trough-like depressions 39 in the surfaces of the holding sections, as can be seen in FIG. 5, if they are pushed onto the holding sections 30, 31, such that their rounded front surfaces 37*c* (FIG. 4) face the hooks 24, while the substantially planar backs 38 will be located on the outside. Thus on the one hand the front surfaces 37*c* facilitate the easy installation of the clamping rings, while on the other hand, where the backs 38 merge with the rounded front surfaces 37*c*, they give the depressions 39 an angular shape, so that they are secured against undesired removal from the holding sections by a kind of claw-like effect and have a long-lasting hold on them.

Figure 7:
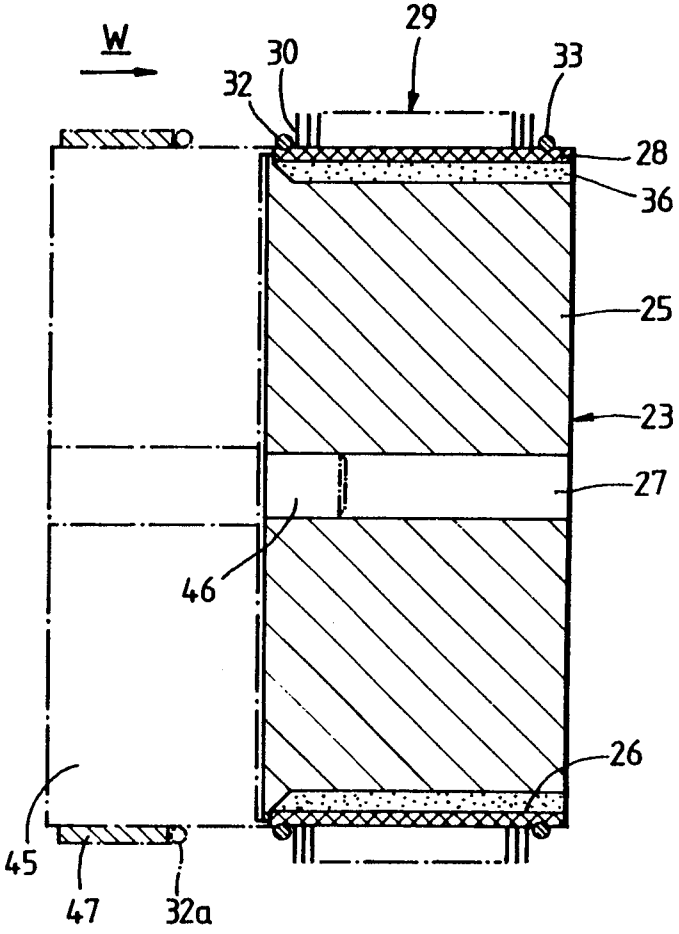
FIGS. 6 and 7 are diagrammatic representations of devices for the mounting of the card clothing and clamping rings of FIGS. 2 to 5, and FIGS. 8 and 9 are a cross section and front elevation, respectively, of another embodiment of the invention.
Figure 6:
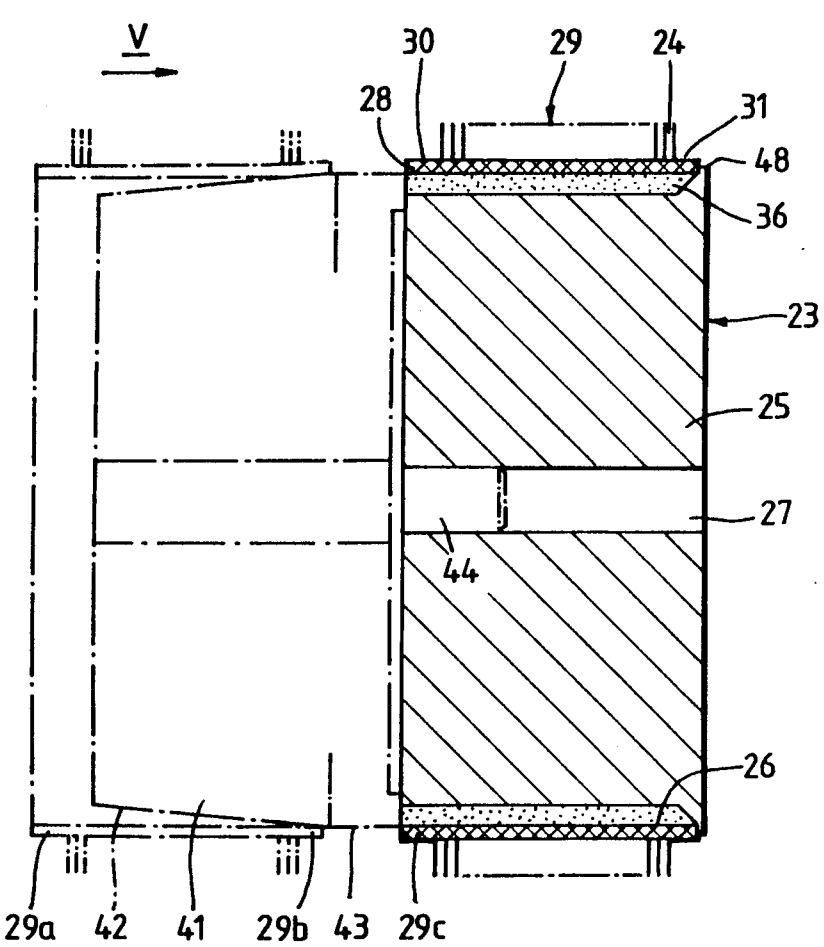

FIGS. 6 and 7 show schematically some simple devices for the installation of the card clothing 29 and clamping rings 32 and 33 in accordance with the invention.

In FIG. 6, a device for drawing the endless card clothing 29 onto the card wheel 23 consists of a drum 41 whose circumferential surface has a conical section 42 of inwardly increasing diameter and a cylindrical section 43 adjoining it at its greatest diameter, which has an outside diameter substantially corresponding to the diameter of the circumferential surface 26 of the card wheel 23.

The conical section 42 has at the outer end—the left end in FIG. 6—a smaller outside diameter than corresponds to the inside diameter of the endless card clothing 29 in its relaxed state, which is indicated by broken lines in FIG. 6, and identified by the reference number 29*a*. On the other hand, the cylindrical section 43 and the circumferential surface 26 preferably have outside diameters that are slightly greater than the inside diameter of the card clothing 29 in the relaxed state.

The cylindrical section 43 of the drum 41 is provided with a projecting pin 44 which is introduced into the center bore 27 of the card wheel in order to center the drum 41 and align the sections 42 and 43 coaxially with the circumferential surface 26.

To install the card clothing 29 the latter is first pushed in the relaxed state corresponding to 29*a*, onto the conical section 42, in the direction of an arrow Y, and thereby it is gradually slightly expanded as indicated by the reference 29*b*. As pushing continues, the front end of the card clothing gradually becomes situated on the cylindrical section 43, by which it is held in a slightly stretched or expanded state and therefore held under a predetermined bias. The front end of the card clothing finally slides from the cylindrical section 43 onto the circumferential surface 26. This state is indicated by the reference 29*c* in FIG. 6.

FIG. 7 shows a device for installing the endless clamping ring 32 on the holding section 30 after the card clothing 29 has already been installed. This device too contains a drum 45 with a projecting pin 46 serving for centering. The drum 45 has an outside diameter corresponding to the inside diameter of the ring 32 or even a slightly smaller diameter, so that the ring 32 can be forced onto it in the direction of the arrow w to a position, for example, which is indicated by the reference number 32*a*. A sleeve 47 which can be pushed onto the drum 45 serves to force the clamping ring 32 onto the holding section 30; the front end of the sleeve, as seen in FIG. 7, is placed against the ring 32 at position 32*a* and is then pushed in toward the card wheel 23. The ring 32 is thus driven along and finally transferred to the holding section 30. On account of its rounded face, it causes the cloth band 28 to yield radially inwardly, although its outside diameter is slightly greater, when it is on the circumferential surface 26, than the outside diameter of the drum 45 or the inside diameter of the clamping ring 32. The installation of the other clamping ring 33 is performed in a similar manner, except that in this case the drum 45 and the sleeve 47 are installed on the card wheel 23 from the right in FIG. 7.

Alternatively, it is possible to use means other than the devices of FIGS. 6 and 7. For example, the card clothing 29 can be drawn on by hand and the clamping ring 32, 33, can be forced on with a screwdriver or the like.

In order to assure the correct centered seating of the card clothing 29 on the card wheel 23, the latter has at one lateral end a radially projecting circumferential bead 48 (FIGS. 3 and 6) whose outside diameter is greater than the outside diameter of the circumferential surface 26. If a substantially rigid, endless clamping ring 33 is used, this bead 48 must also have an outside diameter that is smaller than the inside diameter of the ring 33 so that the latter can be forced over the bead 48 onto the holding section 31. The bead 48 serves as an abutment when the card clothing 29 is installed (FIG. 6) and prevents the card clothing 29 from being erroneously pushed too far forward.

To prevent errors in the installation of the card clothing 29 and of the clamping rings as shown in FIGS. 6 and 7, a certain coding is preferably provided. For example, in FIGS. 2 and 6 the holding section 30 must be on the left, but holding section 31 on the right, so that the hooks 24 will be pointing in the direction required for the operation of the card wheel, because the card wheel 23 can be fastened on the knitting machine only in a very specific position. To prevent malfunction, the holding section 30 is made, in accordance with the invention, wider, for example, than holding section 31. Thus the operator can be acquainted with the fact that the card clothing 29 has been installed correctly if its narrow holding section 31 is against the bead 48. Furthermore, clamping rings 32 and 33 and card clothings 29 that belong together are always marked with the same color, so that, for example, only yellow clamping rings may be combined with card clothing whose cloth bands are also yellow. Thus it is possible in a simple manner to assure that, when card clothings are used whose cloth bands may have different thicknesses and must therefore be combined with clamping rings which have correspondingly different inside ring diameters, no difficult measurements or the like have to be made in order to select from an unsorted supply of card clothings and clamping rings the ones that belong together. If different sizes of card wheel are used, they can also be coded with matching colors or otherwise.

The cloth band 28, when in the relaxed state, has a thickness of 3 mm, an inside diameter of 136 mm and an outside diameter of 142 mm. The outside diameter of the circumferential surface 26 amounts to 140 mm, so that the cloth band 28 when installed has an inside diameter of 140 mm and an outside diameter of 146 mm, with the thickness substantially unchanged. The clamping rings of circular cross section have an inside ring diameter of 145 mm and a cross sectional diameter of 3.4 mm, so that, in the installed state, the depth of penetration in the area of the indentations 34 and 35 (FIG. 3) will be approximately 0.5 mm in the assembled state.

The width of the holding sections 30 and 31 can be as desired. It should, however, be greater than the width of the indentations 34 and 35 that form, so that the latter are fully formed on both sides of the clamping rings and give the clamping rings a firm seat in the axial direction.

The invention is not limited to the embodiments described, which can be modified in many ways. In particular it is possible to mount the card clothing 29 in a known manner, not directly on the wheel body 25, but on a sleeve or the like, which is then fastened on the wheel body by shrinking it or the like (DE-OS 31 33 280). In this case the circumferential surface 26 is formed by the circumferential surface of the sleeve or of a coating additionally applied to the latter. Provision can also be made for providing the surfaces of the clamping rings 32 and 33 with nubs, grooves or the like to increase their friction, or to roughen them in some other way in order thereby to make displacements of the rings on the holding sections largely impossible.

Figure 8:
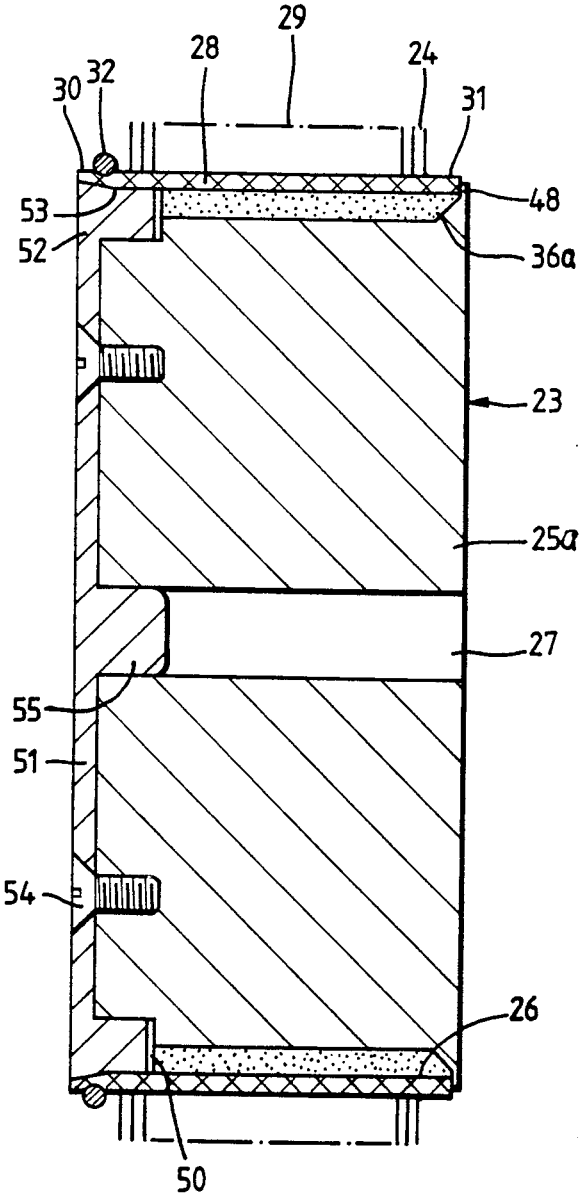
Figure 9:
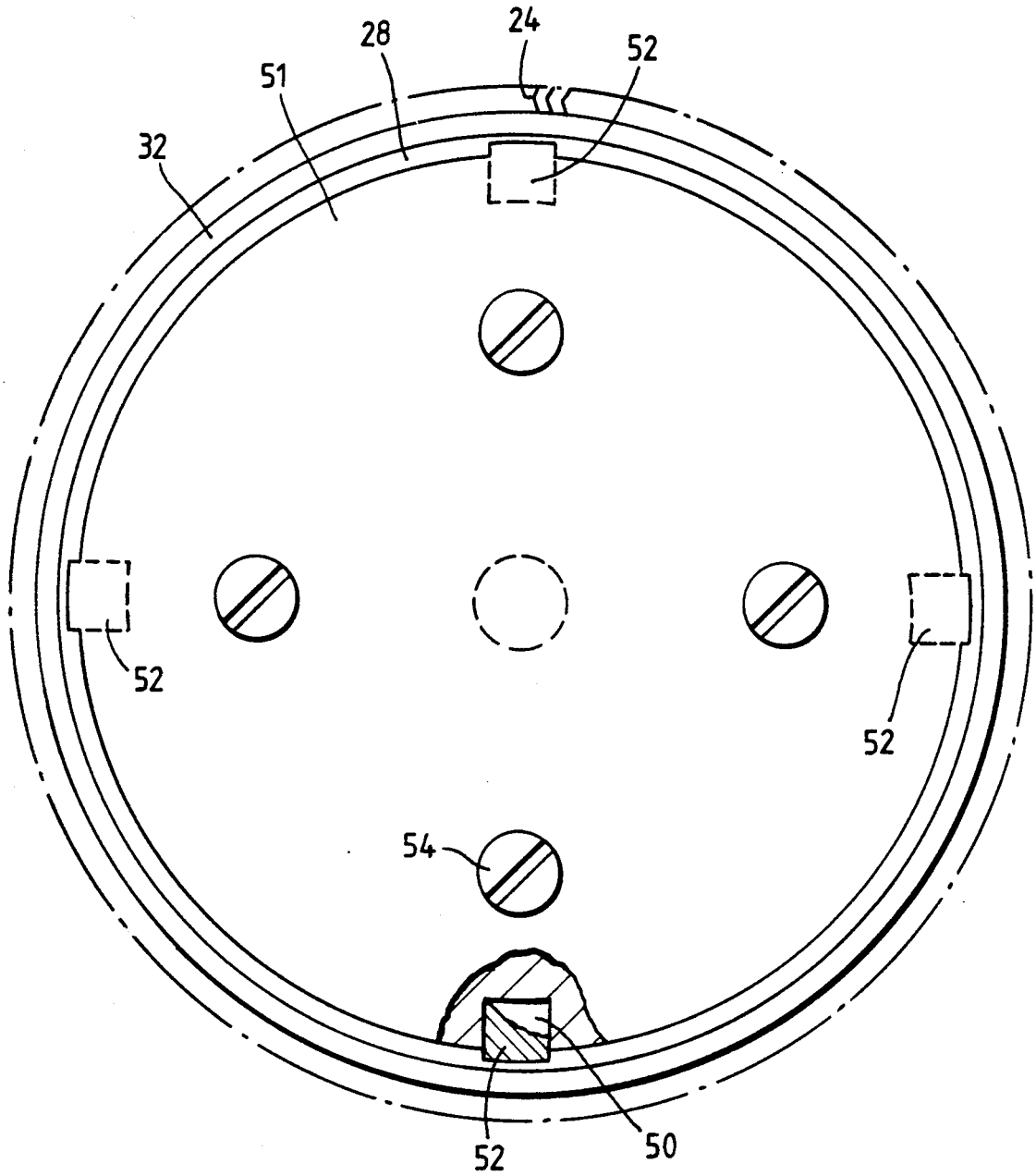

In the embodiment seen in FIGS. 8 and 9, in which the same reference numbers are used for the same parts, at least one end face of the wheel body 25*a* has on its circumference a plurality of grooves or pockets 50 with a substantially axially parallel bottom. As seen in FIG. 9, for example, four such pockets 50 are provided, which can also reach through the coating 36*a* if present.

To further increase the pressure per unit area or clamping force between the holding section 30 and the circumferential surface 26 and the clamping ring 32, the clamping means additionally has a cover 51 which is provided on its interior with a number of cams 52 corresponding to the number of pockets 50, and has an outside diameter corresponding substantially to the diameter of the circumferential surface 26. The cams 52 are dimensioned such that, when the cover 51 is placed on the face of the wheel body 25*a*, they penetrate into the pockets 50 and apply themselves with clamping surfaces 53 of a skid-like configuration against the cloth band 28 from the inside, expand it increasingly radially, and finally clamp it tightly between themselves and the clamping ring 32. The clamping surfaces 53 are for this purpose made to slope from the inside out or they are rounded in some other manner, as shown especially in FIG. 8. This considerably increases the pressure per unit area or clamping action on the cloth band 28 at several points on the circumference of the wheel body 25*a*, so that, even if very heavy goods are being produced, there is no danger that the cloth band 28 will slip on the circumferential surface 26.

The cover 51 is fastened, for example, by means of screws 54 to the wheel body 25*a*. For centering, the cover 51 can be provided with a central pin 55 penetrating into the central bore 27 of the wheel body 25*a*. Alternatively, it is possible to configure the sides of the cams 52 facing the bottoms of the pockets 50 as axially parallel sliding or guiding surfaces which center themselves on the bottom of the pockets 50 when the cover 51 is installed on the wheel body 25*a*. Such an embodiment is suitable in cases in which such covers are to be provided on both end faces of the wheel body 25*a* and at least one of the covers must have a central hole to enable the wheel body to be placed on a drive shaft.

In the embodiment in accordance with FIGS. 8 and 9 it is furthermore possible to give the clamping ring 32 an inside diameter substantially corresponding to the outside diameter of the cloth band 28 and to apply the surface pressure substantially only with a corresponding number of cams 52.

It would also be conceivable to provide only one pocket 50 running circumferentially in the end faces of the wheel body 25*a* and optionally to provide the cover with a preselected number of cams 52 or a single cam also running circumferentially.

Lastly, the invention is not limited to the use of clamping rings of steel or the like which are rigid or substantially rigid, at least in the tension direction, i.e., in the circumferential direction of the card wheels, if such clamping rings have proven heretofore to be the best embodiment. Suitable for the purposes of the invention are, for example, clamping rings made of rubber-like materials which are stretchable at least in the pulling direction, e.g., Polycord (a polyurethane elastomer). Such rings, which are preferably round cord rings, are butt-welded in a stream of hot air at their end faces. An inside ring diameter of about 125 mm at a material thickness of 4 mm has proven to be useful under otherwise the same conditions as in the example given above. Instead of rubber-like materials, however, coil springs or the like can also be used, and in both cases the bias or resilient elongation to be established in the installed state will depend on the qualities of the particular material.

Those coil springs have proven to be especially suitable which have been used heretofore in the knitting machine art to secure the knitting needles in the cylinders of circular knitting machines. The two ends of these coil springs are joined by screwing them together. Any twisting of the coil springs produced by assembly can be remedied afterward by lifting them momentarily in order to prevent any tendency they might have to roll spontaneously off from the ends of the card wheel.

We claim:

1. Card wheel for a knitting machine for producing knit goods with combed-in fibers, comprising: a wheel body with a cylindrical circumferential surface; a flexible card clothing placed on said surface, said clothing consisting of a cloth band and of hooks incorporated into the band, and having on at least one lateral end a holding section free of hooks and running around the entire circumferential surface; and a clamping means surrounding said wheel body and said holding section, said clamping means being placed onto and clamping the holding section with a pressure against the circumferential surface sufficient to prevent only by means of said pressure, slippage of the cloth band and distortions thereof on said surface during operation of the card wheel.

2. Card wheel in accordance with claim 1, wherein the clamping means is an endless ring and has an inside ring diameter that is smaller than the outside diameter of the holding section when the latter is placed on the circumferential surface, but greater than the diameter of the circumferential surface.

3. Card wheel in accordance with claim 1, wherein the clamping means is a ring having a runner-like front face.

4. Card wheel in accordance with claim 1, wherein the clamping means is a ring having a substantially semicircular cross section.

5. Card wheel in accordance with claim 1, wherein the cloth band consists of an endless cylindrical band pushed as a whole onto the circumferential surface.

6. Card wheel in accordance with claim 1, wherein the circumferential surface is formed by a resilient, wear-resistant coating applied to the wheel body.

7. Card wheel in accordance with claim 1, wherein the circumferential surface of the wheel body is formed by a sleeve applied to the latter.

8. Card wheel in accordance with claim 1, wherein the cloth band where it is occupied by hooks has the same width along the entire circumferential surface.

9. Card wheel in accordance with claim 2, wherein the wheel body has a bead projecting radially above the circumferential surface on one lateral margin thereof, the outside diameter of the bead being greater than the outside diameter of the circumferential surface but smaller than the inside ring diameter of the clamping ring.

10. Card wheel in accordance with claim 1, wherein the carding cloth and the clamping means and the card wheel body are provided with identical coding to show that they fit together.

11. Card wheel in accordance with claim 2, wherein the clamping ring consists of a material that is substantially unyielding in tension direction.

12. Card wheel in accordance with claim 2, wherein the clamping ring consists of a material that is resilient in tension direction.

13. Circular knitting machine with at least one carding apparatus which has at least one card wheel, for the production of knot goods with combed-in fibers, the card wheel being constructed in accordance with claim 1.

* * * * *